US006239775B1

(12) United States Patent
Kang

(10) Patent No.: US 6,239,775 B1
(45) Date of Patent: May 29, 2001

(54) DRIVING CIRCUIT OF PLASMA DISPLAY PANEL

(75) Inventor: Seong Ho Kang, Taegu-kwangyoksi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/093,911

(22) Filed: Jun. 9, 1998

(30) Foreign Application Priority Data

Jun. 14, 1997 (KR) ..... 97-24730

(51) Int. Cl.[7] ..... G09G 3/28

(52) U.S. Cl. ..... 345/60; 345/204; 345/208; 315/169.4

(58) Field of Search ..... 345/60, 61, 62, 345/63, 204, 205, 208, 209, 210, 211; 315/169.3, 169.2, 169.4

(56) References Cited

U.S. PATENT DOCUMENTS

| | | | | |
|---|---|---|---|---|
| 3,938,137 | * | 2/1976 | Ngo et al. | 345/60 |
| 3,962,700 | * | 6/1976 | Criscimagna et al. | 345/60 |
| 4,063,223 | * | 12/1977 | Schlig et al. | 345/60 |
| 5,089,812 | * | 2/1992 | Fuse et al. | 345/89 |
| 5,122,792 | * | 6/1992 | Stewart | 345/148 |
| 5,446,344 | | 8/1995 | Kanazawa | 315/169.4 |
| 5,943,030 | * | 8/1999 | Minamibayashi | 345/60 |

* cited by examiner

*Primary Examiner*—Xiao Wu
(74) *Attorney, Agent, or Firm*—Fleshner & Kim, LLP

(57) ABSTRACT

A driving circuit of a PDP is disclosed. To minimize loading time of a digital picture signal in a driving method of a PDP, there is provided a decoder between an output terminal of a conventional shift register and an input terminal of a latch part. Alternatively, instead of the shift register, there are provided a decoder and a line selector between an input terminal of n bit scan data and an input terminal of a latch part. Therefore, it is possible to realize a driving circuit of an AC PDP having high resolution of pixels of 640×480 or more, in which loading time of scan data is 1 μs or below.

8 Claims, 4 Drawing Sheets

DRIVING CIRCUIT OF PLASMA DISPLAY PANEL

BACKGROUND OF THE INVENTION

1. Field of the Invention

The present invention relates to a driving circuit of a plasma display panel (PDP), and more particularly, to a driving circuit of a PDP in which high resolution of pixels of 640×480 or more can be realized by minimizing loading time of a digital picture signal in a driving method of a flat panel display.

2. Discussion of the Related Art

Generally, a PDP is discharged by adjusting a voltage applied between vertical and horizontal electrodes of a cell constituting pixels. The amount of discharged light is adjusted by varying discharge time in the cell.

The overall screen of the PDP is formed in such a manner that the PDP is driven in a matrix arrangement by applying a write pulse for inputting a digital picture signal to the vertical and horizontal electrodes in each cell, a scan pulse for scanning, a sustain pulse for sustaining discharge, and an erase pulse for erasing discharge of the discharged cell.

Grey level required for picture display is realized by making discharge time of each cell be different within a given time period (for example, 1/30 second in NTSC TV signal) required for the overall picture display. At this time, brightness of the screen is determined by grey level from when each of the cell is driven at a maximum level. To increase the brightness, the driving circuit should be designed in such a manner that discharge time of the cell is sustained as long as possible within a given time period for displaying one screen.

FIG. 1 is a block diagram illustrating a driving circuit of a conventional PDP.

As shown in FIG. 1, the PDP includes a panel 1, an address electrode driver 4, a scan driver 3, a common electrode driver 5, and a controller 2. The panel 1 is formed by vacuum coupling of a front glass substrate and a rear glass substrate. On the front glass substrate, a scan electrode and a common electrode are formed. On the rear glass substrate, an address electrode is formed. The address electrode driver 4 applies digital picture data to the address electrode. The scan driver 3 applies scan data to the panel 1 to determine whether or not the panel 1 should be driven. The common electrode driver 5 drives the common electrode of the panel 1. The controller 2 provides various signals and data required for driving the drivers 3, 4 and 5.

In the conventional PDP, externally applied various signals such as clock signals, RGB signals, vertical synchronizing signals Vsync, and horizontal synchronizing signals Hsync are provided to the controller 2. The controller 2 applies scan data and control signals to the scan driver 3 and address data and an address clock to the address electrode driver 4.

If the scan electrode and the common electrode are driven in response to the signals applied to the respective drivers, the data provided to the address electrode can be displayed on the panel 1.

The scan driver 3 is a very important factor, which determines whether or not the panel 1 should be driven. The detailed configuration of the scan driver 3 will be described with reference to FIG. 2.

As shown in FIG. 2, the scan driver 3 includes a shift register 12, a latch part 13, and a high pressure pulse generator 14. The shift register 12 transfers scan data per 1 bit to each electrode line in parallel in response to predetermined clock pulse. The latch part 13 counts the scan data of the shift register 12. The high pressure pulse generator 14 outputs the scan data output from the latch part 13 by loading the scan data to an alternating current (AC) high pressure pulse.

The high pressure pulse generator 14 can randomly vary the outputs of the scan data in response to a polarity signal pol and a selection signal cs. However, since the shift register 12 shifts total m bit scan data per 1 bit in response to clock pulse of 25 MHz, the time required for loading of the scan data is 1.28 $\mu$s per 32 bit and 1.6 $\mu$s per 40 bit.

The conventional PDP has a problem. That is to say, for loading of the scan data at a desired bit, the scan driver requires a predetermined sized shift register. To randomly vary the final output data of the high pressure pulse generator, shift clock is required as much as the size of the shift register. This results in that the loading time of 1 $\mu$s or more is required for loading of the scan data to the shift register.

SUMMARY OF THE INVENTION

Accordingly, the present invention is directed to a driving circuit of a PDP that substantially obviates one or more of the problems due to limitations and disadvantages of the related art.

An object of the present invention is to provide a driving circuit of a PDP in which loading time for loading scan data to each electrode line can be minimized and final output data of a high pressure pulse generator can randomly be varied.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a decoder between an output terminal of a conventional shift register and an input terminal of a latch part. Alternatively, instead of the shift register, there are provided a decoder and a line selector between an input terminal of n bit scan data and an input terminal of a latch part. Therefore, the n bit scan data can be decoded to desired electrode lines. As a result, a driving circuit of an AC PDP can be designed, in which loading time of the scan data is 1 $\mu$s or below.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 3:
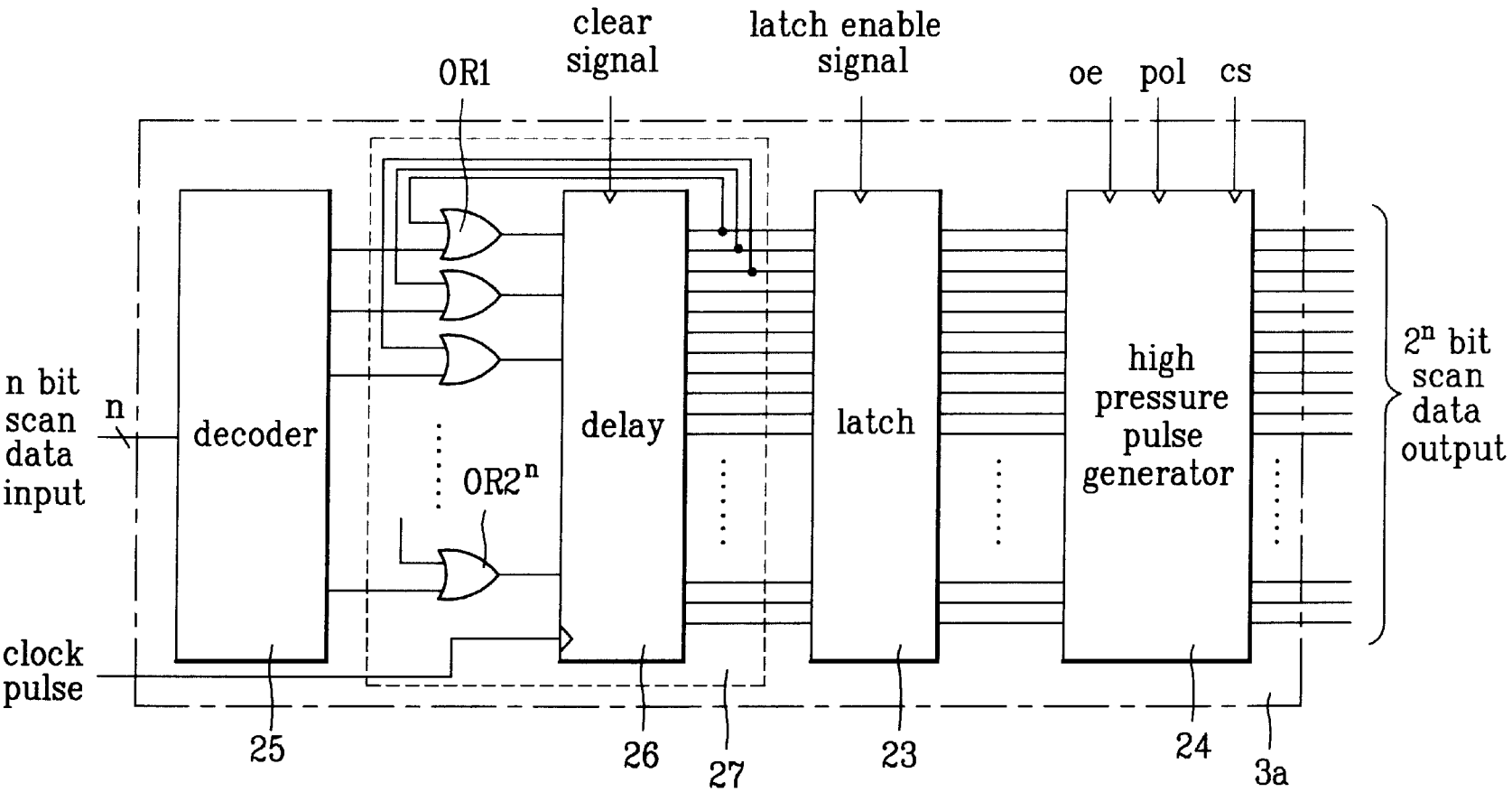
FIG. 3 is a block diagram illustrating a driving circuit of a PDP according to one embodiment of the present invention.

As shown in FIG. 3, a driving circuit of a PDP according to one embodiment of the present invention includes a decoder 25, a line selector 27, a latch part 23, and a high pressure pulse generator 24. The decoder 25 decodes n bit scan data. The line selector 27 selects each electrode line to output the scan data of the decoder 25 to desired electrode lines in response to a predetermined clock pulse. The latch part 23 counts the scan data of the line selector 27. The high pressure pulse generator 24 outputs the scan data from the latch part 23 by loading the scan data to an AC high pressure pulse.

Further, the line selector 27 includes a plurality of OR gates OR1~OR2$^n$ connected to output terminals of the decoder 25, and a delay part 26 connected to output terminals of the OR gates OR1~OR2$^n$ and input terminals of the latch part 23. The delay part 26 includes a Dflip-flop designed by a plurality of logic circuits.

In the aforementioned driving circuit of the present invention, n bit scan data (e.g., 6 bit scan data) are applied to an input terminal of the decoder 25. The data decoded by the decoder 25 are applied to one input terminals of the OR gates OR1~OR2$^n$ and at the same time the data delayed by the delay part 26 are applied to the other input terminals of the OR gates OR1~OR2$^n$.

At this time, the data delayed by the delay part 26 are output in response to clock pulse of 20 MHz, and then are to be feedback to the one input terminals of the OR gates OR1~OR2$^n$. As a result, the inputs of n bit scan data are varied. The line selector 27 can output at once the scan data of electrode lines sequentially selected from the varied inputs of the scan data.

In other words, a desired electrode for selection provides the decoded input data to the input terminals of the OR gates OR1~OR2$^n$. At the same time, the data delayed by the delay part 26 are output and then the output results are to be feedback to the OR gates OR1~OR2$^n$. As a result, the selected electrode can continuously be maintained as it is. In addition, the other electrodes can sequentially be selected or a plurality of electrodes can randomly be selected at once.

Subsequently, the latch part 23 counts the scan data of the line selector 27. The scan data output from the latch part 23 are output by being loaded to the AC high pressure pulse of the high pressure pulse generator 24.

The PDP requires sub-field of 8 times per one frame to realize 256 grey level. In the present invention, it is assumed that data loading time of 1 $\mu$s is required in selecting 8 lines one time with 8 clock pulses. In this case, total 10 clock pulses are required considering a clear signal and an enable signal. Therefore, data loading time of 0.5 $\mu$s (50 $\mu$s (one period)×10=0.5 $\mu$s) is only required.

In the driving IC of the conventional PDP, the data loading requires at least 1 $\mu$s or more. In other words, if the clock pulse of 20 MHz is used in 40 bit data, the data loading time of 2 $\mu$s (50 $\mu$s×40 clocks=2 $\mu$s) is required. This is the reason why the shift register has a large capacity of 40 bit or more.

Therefore, the high pressure pulse generator 24 outputs 2$^n$ bit data or an inversion data $\overline{\text{data}}$when externally applied polarity signal pol and chip selection signal cs are different levels from each other.

Further, the high pressure pulse generator 24 outputs logic values of the externally applied polarity signal pol and chip selection signal cs, which are equal to each other when the externally applied polarity signal pol and chip selection signal cs are the same level as each other. In other words, the high pressure pulse generator 24 outputs 1 when the externally applied polarity signal pol and chip selection signal cs are high. On the other hand, the high pressure pulse generator 24 outputs 0 when the externally applied polarity signal pol and chip selection signal cs are low.

Figure 4:
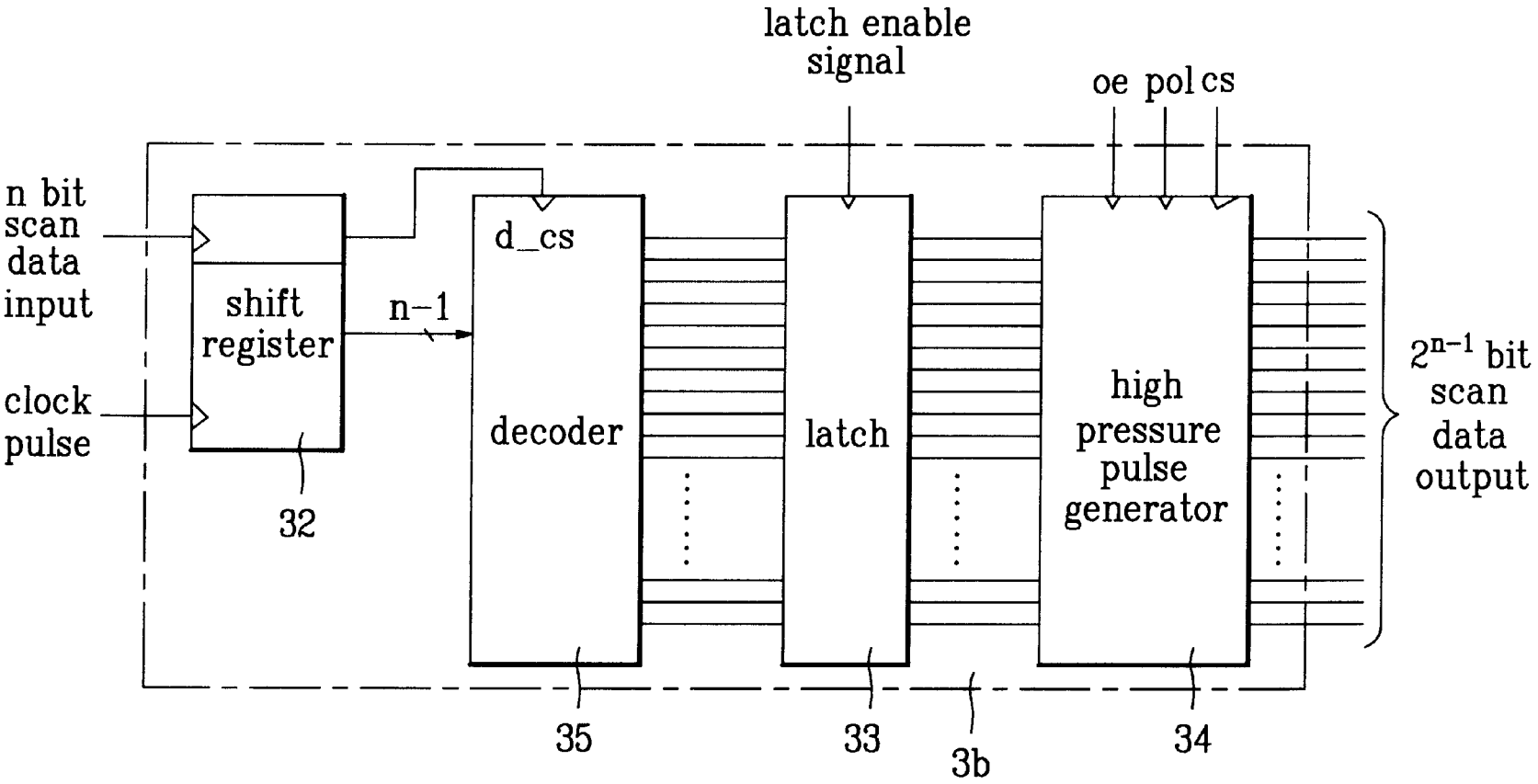
FIG. 4 is a block diagram illustrating a driving circuit of a PDP according to another embodiment of the present invention.

FIG. 4 is a block diagram illustrating a driving circuit of a PDP according to another embodiment of the present invention.

As shown in FIG. 4, the driving circuit of the PDP includes a shift register 32, a decoder 35, a latch part 33, and a high pressure pulse generator 34. The shift register 32 transfers n−1 bit scan data from n bit scan data provided from the controller in response to a predetermined clock pulse. The decoder 35 decodes the scan data of the shift register 32 to be output to a desired electrode line in response to a predetermined clock pulse. The latch part 33 counts the scan data of the decoder 35. The high pressure pulse generator 34 outputs the scan data from the latch part 33 by loading the scan data to the AC high pressure pulse.

The decoder 35 may include various logic gates, for example, an AND gate, an OR gate, a NOR gate, and a NAND gate, in response to a user's selection.

In the driving circuit of the PDP according to another embodiment of the present invention, n bit scan data (e.g., 6 bit scan data) are applied to an input terminal of the shift register 32. The shift register 32 outputs n−1 bit data in response to clock pulse of 20 MHz.

The decoder 35 outputs the data to each electrode line, which are decoded in response to a decoding selection signal d_cs included in the n bit scan data.

Subsequently, the latch part 33 counts the data of the decoder 35. The scan data output from the latch part 23 are output by being loaded to the AC high pressure pulse of the high pressure pulse generator 34. The high pressure pulse generator 34 can randomly vary the $2^{n-1}$ bit scan data in response to the polarity signal pol and the chip selection signal cs. At this time, data loading time of 0.3 $\mu$s (50 $\mu$s (one period)×6=0.3 $\mu$s) is required because 6 clock pulses are required for loading of the scan data.

As aforementioned, the driving circuit of the PDP according to the present invention has the following advantages.

It is possible to realize the driving circuit of the PDP with high resolution by reducing data loading time to 1 $\mu$s or below during scan data loading and randomly varying the output of the high pressure pulse.

Further, since the scan data are input in n(6) bit, it is possible to reduce the size of the shift register. It is also possible for the high pressure pulse generator to load $2^{n-1}$ bit scan data to the selected electrode line at high speed.

It will be apparent to those skilled in the art that various modifications and variations can be made in the driving circuit of the PDP according to the present invention without departing from the spirit or scope of the invention. Thus, it is intended that the present invention covers the modifications and variations of the invention provided they come within the scope of the appended claims and their equivalents.

What is claimed is:

1. A driving circuit of a PDP having a panel for picture display and a controller for providing various signals and data required for driving drivers mounted around the panel, the driving circuit of the PDP comprising:

a decoder for decoding n bit scan data provided from the controller;

a line selector for selecting each electrode line to output the scan data of the decoder to a desired electrode line in response to a predetermined clock pulse;

a latch part for counting the scan data of the line selector; and a high pressure pulse generator for outputting the scan data from the latch part, wherein the line selector includes a plurality of OR gates connected to output terminals of the decoder, and a delay part connected to output terminals of the OR gates and input terminals of the latch part.

2. The driving circuit of the PDP as claimed in claim 1, wherein respective output terminals of the delay part are connected with one input terminals of the OR gates.

3. The driving circuit of the PDP as claimed in claim 1, wherein the high pressure pulse generator outputs $2^n$ bit data or inversion data data when externally applied polarity signal and chip selection signal are different levels from each other.

4. The driving circuit of the PDP as claimed in claim 3, wherein the high pressure pulse generator outputs 1 or 0 when the externally applied polarity signal and chip selection signal are the same level as each other.

5. The driving circuit of the PDP as claimed in claim 5, wherein the high pressure pulse generator outputs 1 when the externally applied polarity signal and chip selection signal are high.

6. The driving circuit of the PDP as claimed in claim 4 wherein the high pressure pulse generator outputs 0 when the externally applied polarity signal and chip selection signal are low.

7. A driving circuit of a PDP having a panel for picture display and a controller for providing various signals and data required for driving drivers mounted around the panel, the driving circuit of the PDP comprising:

a shift register for transferring n−1 bit scan data from n bit scan data provided from the controller in response to a predetermined clock pulse;

a decoder for decoding the scan data of the shift register to be output to a desired electrode line in response to a predetermined clock pulse;

a latch part for counting the scan data of the decoder; and a high pressure pulse generator for outputting the scan data from the latch part.

8. The driving circuit of the PDP as claimed in claim 7, wherein the decoder determines decoding by means of a chip selection signal.

* * * * *

UNITED STATES PATENT AND TRADEMARK OFFICE

CERTIFICATE OF CORRECTION

PATENT NO. : 6,239,775 B1
DATED : May 29, 2001
INVENTOR(S) : Seong Ho Kang

Figure 1:
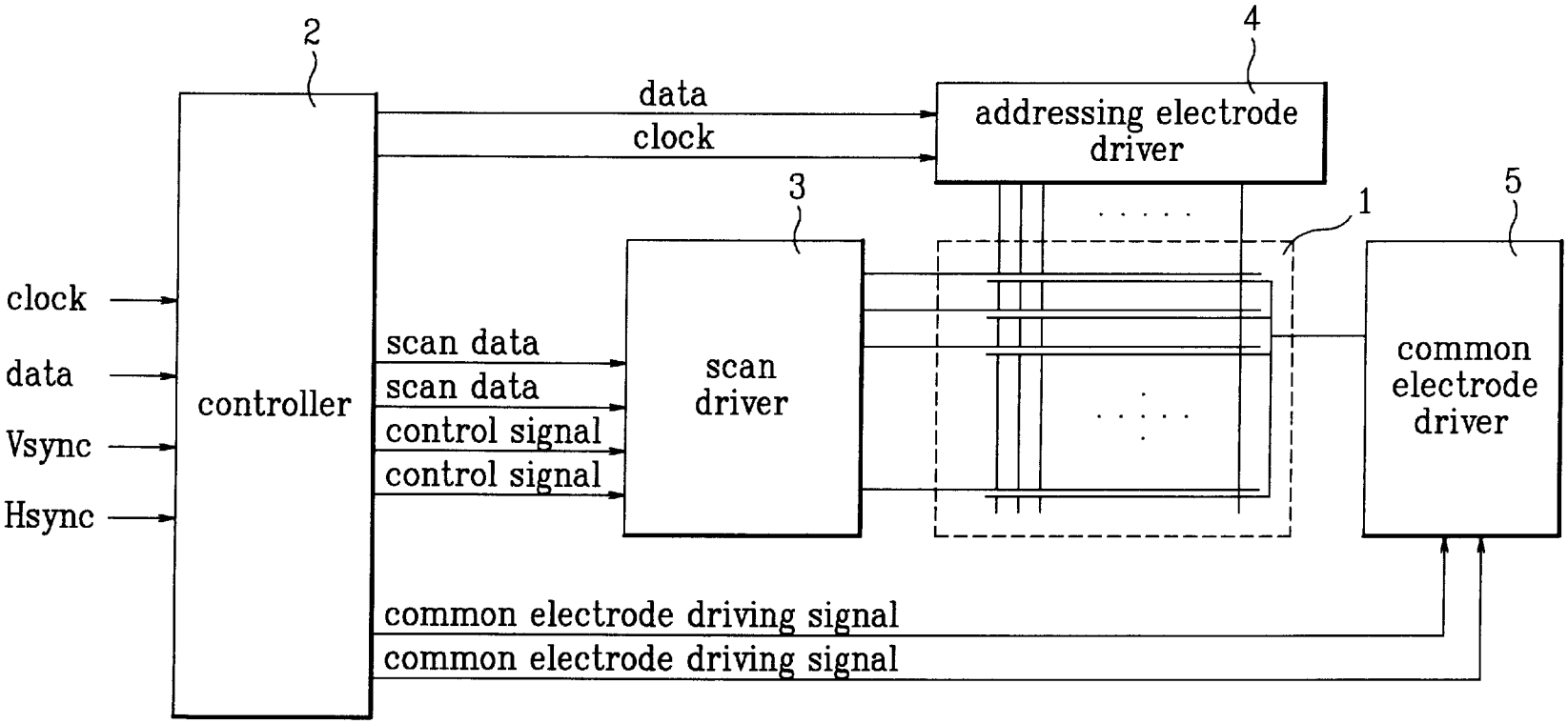
FIG.1 prior art
FIG. 1 is a block diagram illustrating a conventional PDP module.
Figure 2:
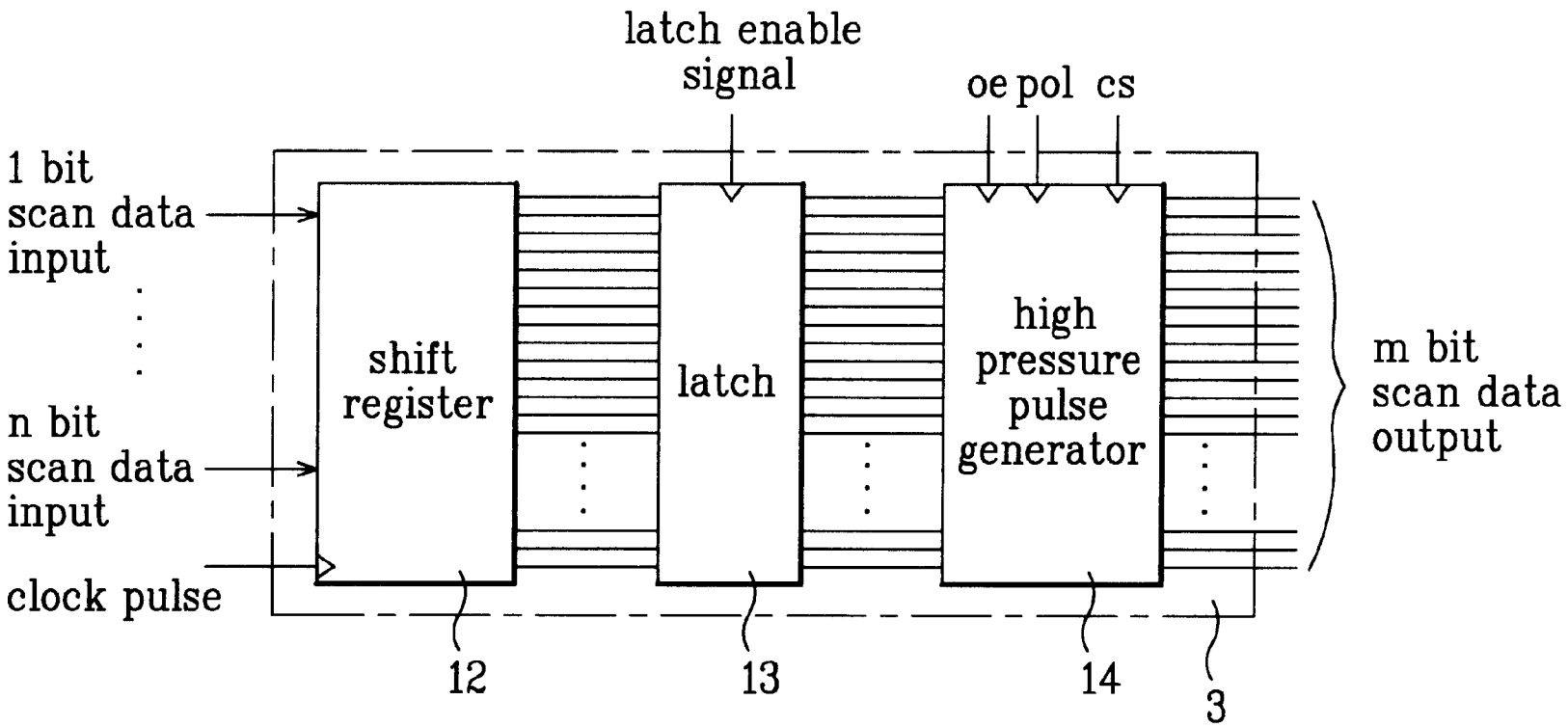
FIG.2 prior art
FIG. 2 is a block diagram illustrating a driving circuit of the PDP of FIG. 1.

It is certified that error appears in the above-identified patent and that said Letters Patent is hereby corrected as shown below:

Title page,
Illustrative figure, fourth box from the left, change “pressure” to -- voltage --;

Drawings,
Figure 2, Sheet 2 of 4, third box from the left, change “pressure” to -- voltage --;
Figure 3, Sheet 3 of 4, fourth box from the left, change “pressure” to -- voltage --;
Figure 4, Sheet 4 of 4, fourth box from the left, change “pressure” to -- voltage --.

Column 1,
Line 66, change “pressure” to -- voltage --;

Column 2,
Line 3, change “pressure” to -- voltage --;
Line 6, change “pressure” to -- voltage --;
Line 7, change "pressure" to -- voltage --;
Line 16, change “pressure” to -- voltage --;
Line 29, change “pressure” to -- voltage --.

Column 3,
Line 14, change “pressure” to -- voltage --;
Line 19, change “pressure” to -- voltage --;
Line 20, change “pressure” to -- voltage --;
Line 53, change “pressure” to -- voltage --;
Line 54, change “pressure” to -- voltage --.

Column 4,
Line 1, change “pressure” to -- voltage --;
Line 5, change “pressure” to -- voltage --;
Line 10, change “pressure” to -- voltage --;
Line 12, change “pressure” to -- voltage --;
Line 20, change “pressure” to -- voltage --;
Line 26, change “pressure” to -- voltage --;
Line 28, change “pressure” to -- voltage --;
Line 42, change “pressure” to -- voltage --;
Line 43, change both occurrences of “pressure” to -- voltage --;
Line 55, change "pressure" to -- voltage --;
Line 58, change “pressure” to -- voltage --.

UNITED STATES PATENT AND TRADEMARK OFFICE

CERTIFICATE OF CORRECTION

PATENT NO. : 6,239,775 B1
DATED : May 29, 2001
INVENTOR(S) : Seong Ho Kang

It is certified that error appears in the above-identified patent and that said Letters Patent is hereby corrected as shown below:

Column 5,
Line 14, change “pressure” to -- voltage --;
Line 24, change “pressure” to -- voltage --;
Line 29, change “pressure” to -- voltage --.

Column 6,
Line 4, change “pressure” to -- voltage --;
Line 8, change “pressure” to -- voltage --;
Line 23, change “pressure” to -- voltage --.

Signed and Sealed this

Twentieth Day of August, 2002

*Attest:*

*Attesting Officer*

JAMES E. ROGAN
*Director of the United States Patent and Trademark Office*